United States Patent [19]

Oxley

[11] 3,980,377

[45] Sept. 14, 1976

[54] PRINTED CIRCUIT CONNECTOR

[75] Inventor: Vincent C. Oxley, Wayland, Mass.

[73] Assignee: GTE Laboratories Incorporated, Waltham, Mass.

[22] Filed: Aug. 25, 1975

[21] Appl. No.: 607,163

[52] U.S. Cl. ..... 339/75 MP; 339/176; 339/176 MP

[51] Int. Cl.[2] ..... H01R 13/26

[58] Field of Search ..... 339/75 MP, 176 MP, 47 R, 339/17 L

[56] References Cited

UNITED STATES PATENTS

| | | | |
|---|---|---|---|
| 3,920,302 | 11/1975 | Cutchaw | 339/75 MP |
| 3,923,361 | 12/1975 | Rosen | 339/75 MP X |

FOREIGN PATENTS OR APPLICATIONS

| | | | |
|---|---|---|---|
| 44-22981 | 9/1969 | Japan | 339/75 MP |

*Primary Examiner*—Roy Lake
*Assistant Examiner*—E. F. Desmond
*Attorney, Agent, or Firm*—Irving M. Kriegsman; Leslie J. Hart

[57] ABSTRACT

A printed circuit board connector includes a plurality of contact members each of which is formed of one or more pieces of spring biased material. A contact member includes a cam portion and a contact portion which are generally rotatable about an intermediate pivot point. The cam portion extends normally into the space to be occupied by a printed circuit board when inserted into the connector. The contact portion is positioned normally within the connector body so as to be free from contact with the entering circuit board until after the board contacts the cam portion of the contact member when nearly completely inserted. At this time, the cam and contact portions are rotated about the pivot point by the action of the printed circuit board bringing the contact portion into mechanical and electrical contact with a conductor on the surface of the printed circuit board.

9 Claims, 5 Drawing Figures

PRINTED CIRCUIT CONNECTOR

BACKGROUND OF THE INVENTION

The present invention relates generally to electrical connectors and is more particularly concerned with a novel printed circuit board connector which retains the simplicity inherent in conventional printed circuit board connectors and yet provides protection for both the printed circuit board and the electrical contacts within the connector upon repeated insertions and withdrawals of the printed circuit board.

Conventional printed circuit board connectors generally include a plurality of separate electrical contacts which are spring biased metallic members. These members usually act against the printed circuit board during the insertion of the board into the connector. These contact members maintain a generally constant pressure against the surface of the printed circuit board until that board has been withdrawn from the connector. This continuous pressure is intended to insure adequate electrical contact with a conductor on the surface of the printed circuit throughout the useful life of board and connector board.

Two principal disadvantages are encountered with respect to such a connector during extended usage. Firstly, to insure adequate electrical contact between contact members and the printed circuit board, significant spring biasing forces are required to be associated with the contact members. When the printed circuit board is inserted into the connector body, the board and contact member each encounter these forces at the edge where, as a result of the force concentration at the edge, the edge is susceptible to damage after a number of insertions. As a result, wear or damage to the contact member increases significantly through contact with the damaged edge of the board. Secondly, the electrical contact on the member is generally made to a conductive strip on the printed circuit board through the use of a precious metal (often gold) at the point of contact. The extensive rubbing of the member at the point of contact at the edge of the board along the board material and along the conductive members during the insertion of the board into the connector causes excessive wearing of the precious metal as it is in constant contact with the board during insertion.

Numerous attempts have been made to alleviate either or both of the foregoing problems. These potential solutions include increasing the amount of precious metal utilized in the contact, which necessarily involves a significant increase in the cost of production of such connectors. Other connectors have utilized complex mechanical arrangements to alleviate mechanical contact between the printed circuit board and the connector members during the insertion of the printed circuit board into the connector. Most such arrangements result in connectors in which the number of components and their mechanical interrelationships are increased greatly, thereby further augmenting the cost of such connectors.

SUMMARY OF THE INVENTION

It is, therefore, among the objects of the present invention to provide a novel printed circuit board connector which allows for minimal contact forces to exist between the printed circuit board and the electrical contacts in the connector.

A second object of the invention is to provide such a connector in which reduced wear on the contact member is reduced without greatly increasing the cost or complexity of the connector.

It is another object of the invention to provide such a connector in which the contact member is formed of one or more pieces of resilent, electrically conductive material.

Briefly, the invention in its broadest aspect is a printed circuit board connector having a hollow insulating body and a plurality of electrical contact members therein. The hollow insulating body has a predetermined length and an oblong slot in the top thereof for receiving a printed circuit board therethrough. The interior of the hollow insulating body has a bottom surface against which the fully inserted printed board bears and includes means for guiding the board within the connector. The plurality of electrical contact members lie in generally regularly spaced, vertically oriented parallel planes which are generally normal to the oblong slot in the top of the insulating body. Each of the contact members comprises a terminal portion, a cam portion, and a contact portion. These portions are all mechanically and electrically interconnected. The terminal portion is secured fixedly in and passes through the bottom of the insulating body to form a terminal below the insulating body to which electrical connection may be made. The cam portion normally projects downwardly toward the bottom of the interior of the body and into that portion of the interior to be occupied by the fully inserted printed circuit board. The cam and contact portions are mutually rotatable about an intermediate pivot point. The contact portion is affixed to the other end normally positioned in a vertical plane within the hollow insulating body adjacent to and separated from the printed circuit board connector as it enters the connector. Therefore, when the printed circuit board is inserted into the connector, it enters free of contact with the contact portion until the board strikes the cam portion when nearly fully inserted. The cam portion is then rotated about the intermediate pivot point thereby also rotating the contact portion in like manner to bring the contact portion into both mechanical and electrical contact with the printed circuit board. The initial mechanical contact at an edge of the board is thereby separated from the electrical contact by the contact portion so that wear on the contact portion is minimized.

These and further objects, advantages and features of the present invention will be apparent from the following detailed description of the preferred embodiments of the present invention taken in conjunction with the drawing.

DETAILED DESCRIPTION OF THE PREFERRED EMBODIMENTS

Figure 1:
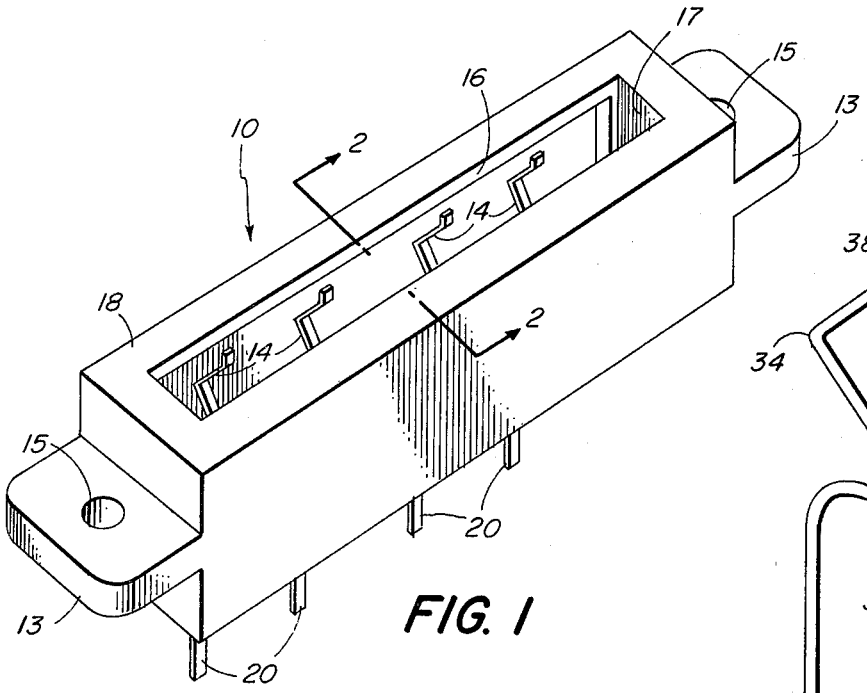
FIG. 1 is an isometric view of a printed circuit board connector according to the present invention.

In referring to the various figures of the drawing hereinbelow, like reference numerals will be used to refer to identical parts of the apparatus.

Referring initially to FIG. 1, there is shown a printed circuit board connector according to the present invention which is indicated generally by the reference numeral 10. The connector 10 is comprised of a hollow body 12 which is formed principally of an insulating material and which has a plurality of separate electrical contact members 14 disposed therein.

The body 12 may be formed of any suitable insulating material, such as various plastic resin compositions which provide the necessary structural strength as well as electrical insulation. The body 12 has a top surface 18 having an oblong slot 16 formed therein. The slot 16, in the preferred embodiment, is of generally rectangular form and of approximately the cross-sectional dimensions of the printed circuit board intended to be inserted into the connector 10. A pair of ears 13 are provided on the opposite ends of the body 10 and have mounting holes 15 therein for affixing the connector 10 to a frame or other structural members.

The interior of the body 12 may be of any desired form, so long as certain configurational constraints are met. Generally, these constraints are that space be available for the electrical contact members to be largely out of the path of the entering circuit board and that protection be provided against inadvertent premature contact between the entering board and the contact members.

To meet these constraints, the interior side wall 19 of the body 12 may be formed such that a recess 28 is formed between the side wall portion 19 and the space below the slot 16 so that the electrical contact members 14 may be positioned generally out of the path of the incoming printed circuit board. At the ends of the slot 16 in block 12 are generally formed a guiding means, such as a pair of channels 17 running vertically into the interior of the body 12. The channels 17 provide a guiding action for the printed circuit board so that it achieves a precise final position in the connector in which the printed circuit board bears against the bottom surface 22 of the hollow interior. Alternatively, and in most embodiments preferably, the lip 28 for the recess which is formed adjacent to the rectangular slot 16 in the top of the body 12 is eliminated, provided that the means 17 is provided for closely guiding the printed circuit boards into the connector 10 without prematurely contacting the electrical contact members 14. The primary advantage of the recess is to provide a measure of protection for the electrical contact members 14 against both dust and accidental contact.

Figure 5:
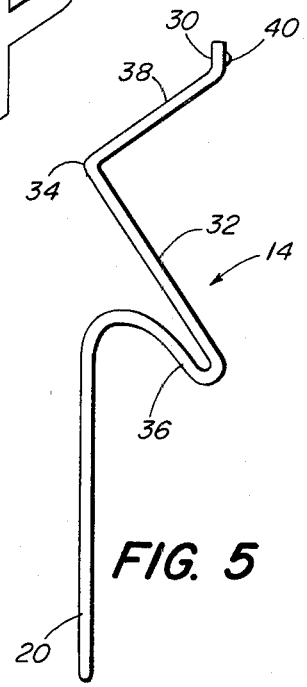

FIG. 5 shows an enlarged side view of a single electrical contact member 14. Generally speaking, the presently preferred embodiment of the electrical contact member 14 is comprised of five sequentially connected sections, a terminal portion 20, an arcuate cam spring portion 36, a cam portion 32, a contact spring portion 38, and a contact portion 30. The terminal portion 20 is securely held in place by the bottom of the connector body 12 through which the terminal portion 20 passes. A portion thereof extends below that bottom and serves to form a terminal to which external electrical connection may be made in any conventional manner. The contact spring portion 38 and the cam portion 32 are joined at their proximal ends at an angle which is disposed generally in line with and above the terminal portion 20. As shown in FIG. 5, this angle is approximately a right angle which is the preferred configuration; however, depending upon the particular design, the angle may also be either obtuse or acute. The limitations on this angle are indirectly applied and will be discussed more fully hereinbelow. The apex of the angle is disposed essentially at an intermediate pivot point 34 about which the cam and contact portions may rotate.

An arcuate cam spring portion 36 extends between the upper end of the terminal portion 20 and the distal end of the cam portion 32. This portion serves to position the cam portion 32 in a desired normal location or position and to bias that portion toward that normal position whenever displaced therefrom. Finally, the contact portion 30 is affixed to the upper end of the contact spring portion 38 and lies generally in a vertical plane. That vertical plane, however, intersects both the cam portion 32 and the cam spring portion 36 and lies adjacent to the path of the entering printed circuit board.

Figure 2:
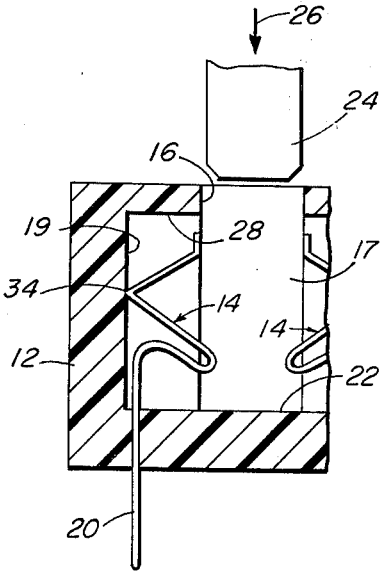
FIGS. 2, 3 and 4 are enlarged, fragmentary sectional views of the printed circuit board connector shown in FIG. 1, illustrating the insertion of a printed circuit board into the connector with the printed circuit board at various stages of insertion, and, FIG. 5 is an enlarged side view of a contact member according to the invention.
Figure 3:
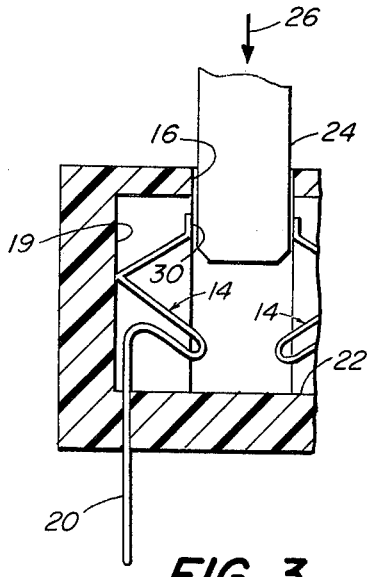
Figure 4:
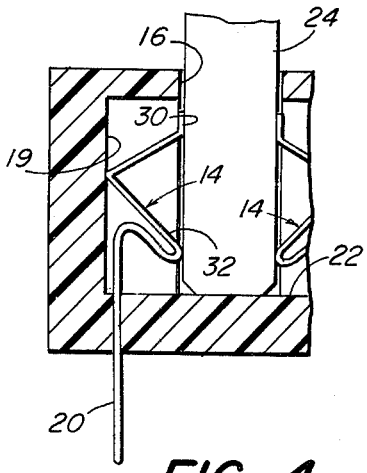

Turning now to FIGS. 2 through 4 wherein a series of cross-sectional views of the connector 10 are shown which are taken along line 2—2 in FIG. 1. In these views, the contact member 14 described hereinabove and shown in FIG. 5 is mounted within the connector body 12. The apex of the angle 34 between the cam and contact spring portions is disposed generally adjacent to a side 19 of the interior of the hollow insulating body 12. The cam portion projects downwardly toward the bottom 22 and outwardly from the wall 19 of the interior of the body 12 and into that portion of the interior to be occupied by the fully inserted printed circuit board 24. The contact spring portion 38 of the electrical contact member 14 projects upwardly from the apex of the angle 34 and outwardly toward the slot 16. However, the contact spring portion terminates normally outside of the space to be occupied by a fully inserted printed circuit board. In this manner, as the printed circuit board 24 is inserted into the connector body 12 by interaction with the guide means 17, the printed circuit board 24 does not engage any part of the electrical contact member 14 until such time as the terminal board 24 approaches the bottom 22 of the interior of the body 12. At that time, the board 24 comes into contact with the cam portion 32 which extends normally into the space to be occupied by the fully inserted board 24. The downward force, as denoted by an arrow 26, of the board 24 against the cam portion 32 causes the cam, contact spring and contact portion to rotate generally in a clockwise manner about the apex of the angle 34. This rotation causes the contact portion 30 of the member 14 to be brought into physical contact with the appropriate portions of the side of the printed circuit board 24.

The angle between the proximal ends of the cam portion 32 and the contact spring portion 38 of the contact member 14, as stated above may extend from obtuse to acute. The only limitations are that the contact portion 30 be able to make the necessary mechanical and electrical contact with a conductor on the side of the printed circuit board and that the angle be sufficiently large to avoid damage to the board 24 or the contact member 14 during the final stage the insertion process. Such damage can occur if the contact portion 30 does not slide on the printed circuit board and a corner or edge of the portion 30 is rolled into contact with the board so that gouging or scratching may occur. Also, the contact member 14 can be permanently damaged. The precise limits of the angle 34 depend on the actual application and the particular materials used.

The initial contact is made shortly before the printed circuit board 24 becomes fully inserted into the connector 10. In this manner, the two primary disadvantages of the prior art printed circuit board connectors are avoided. That is, the edge of the board 24 is not forced to engage the contact member immediately upon insertion of the board into the connector body and to force the contact members to open so that the board may pass therebetween. Here, the board is allowed to pass nearly completely into the connector body prior to coming into contact with any portion of the contact member 14.

A second disadvantage of the prior art connectors is also avoided in that the precious metal contact, such as shown at spot 40 in FIG. 5, on the contact portion 30 is not brought into physical contact with the printed circuit board 24 except for a very short distance prior to the actual seating of the printed circuit board 24 in the connector 10. In this manner, very little of the precious metal can be abraded by the printed circuit board 24 during insertion and removal. However, a small amount of sliding contact therebetween is retained normally so that the respective surfaces are burnished to provide optimal electrical contact therebetween.

Preferably, the contact spring member 14 is formed by a single piece of electrically conductive and mechanically resilient material. However, it is included within the purview of the invention that one or more of the aforedescribed portions may be formed separately and joined together by appropriate means, such as welding, which provides the requisite mechanical and electrical connection therebetween. It is, furthermore, preferable that certain portions of the contact member 14 be more rigid than other portions thereof. For example, the angle 34 would be sufficiently rigid to preclude any significant deformation of that angle upon insertion of a printed circuit board 24 and the forcing of the contact portion 30 against the side of the board. It is also preferable that the terminal portion 20, cam portion 32 and contact portion 30 of the contact member 14 also be more rigid than the contact spring 38 and cam spring 36 portions of the member. This flexibility control can be achieved by appropriate control of the thickness of the material before and the deformation thereof during the stamping process by which the contact member is formed. The reason for the variation in rigidity is to ensure that the member 14 will provide acceptable mechanical force against the side of a printed circuit board to provide good electrical contact yet will allow for proper alignment of actual printed circuit boards within the connector body as the boards commonly exhibit a measure of warpage and/or variation in thickness.

Although there have been described hereinabove what are presently considered to be the preferred embodiments of the present invention, it will be obvious to those having ordinary skill in the art that various changes and modifications may be made therein without departing from the spirit of the invention as defined in the appended claims.

I claim:

1. A printed circuit board connector comprising a hollow insulating body of predetermined length, the insulating body having an oblong slot in the top thereof for receiving a printed circuit board, having a bottom surface in the interior thereof against which a fully inserted board bears, having a recessed portion adjacent to and integral with the oblong slot, and including means for guiding the board within the oblong slot so that the board does enter into the recessed portion, a plurality of electrical contact members each of which lies generally in the recessed portion in a regularly spaced vertically oriented parallel plane which is generally normal to the oblong slot in the top of the insulating body, each of the contact members being comprised of the following portions which are mechanically and electrically interconnected a terminal portion, a cam portion, a contact portion, the terminal portion being fixedly secured in and passing through the bottom of the insulating body to form a terminal below the insulating body to which external electrical connection may be made, the cam portion normally projecting downwardly toward the bottom of the body and into a portion of the slot which is to be occupied by the fully inserted board, the contact portion being normally positioned in a vertical plane within the recessed portion of the hollow insulating body adjacent to and separated from the printed circuit board connector as it enters the oblong slot of the connector, the printed circuit board upon insertion into the oblong slot being free of contact with the contact portion until the board contacts the cam portion when nearly fully inserted which then rotates the cam and contact portions generally about an intermediate pivot point to bring the contact portion into mechanical and electrical contact with the board, and to bring the cam portion out of the oblong slot and into mechanical contact with the board, the initial mechanical contact at an edge of the board being with the cam portion so that wear on the contact portion is minimized.

2. A printed circuit board connector according to claim 1, wherein each contact member further includes a cam spring portion extending in an arcuate manner between the end of the terminal portion in the interior of the insulating body and the downwardly extended end of the cam portion to bias the cam portion toward its normal position when displaced therefrom, and a contact spring portion extending between the upper end of the cam portion and projecting upwardly to the contact portion, the contact spring and cam portions forming an angle therebetween, the apex of which is the intermediate pivot point.

3. A printed circuit board connector according to claim 2, wherein the angle is sufficiently rigid to preclude significant deformation thereof upon insertion of a board.

4. A printed circuit board connector according to claim 3, wherein the electrical contact member is formed of a single piece of electrically conductive material.

5. A printed circuit board connector according to claim 4, wherein the terminal portion, the cam portion and the contact portion are more rigid than the cam spring portion and the contact spring portion.

6. A printed circuit board connector according to claim 2, which further includes an amount of a contact material disposed on the contact portion of the electrical contact member to facilitate electrical contact between the printed circuit board and the member.

7. A printed circuit board connector according to claim 6, wherein the contact material includes a precious metal.

8. A printed circuit board connector according to claim 7, wherein the precious metal is gold.

9. The connector according to claim 1 wherein the hollow insulating body includes a second recessed portion adjacent to and integral with the opposite side of the oblong slot as the first recessed region and further including a second plurality of electrical contact members each of which lies generally in the recessed portion, the cam portion of the first and second plurality of contact members normally projecting downwardly toward the bottom of the body and into no more than one-half the thickness of the oblong slot.

* * * * *